United States Patent [19]

Johnson

[11] 4,186,544

[45] Feb. 5, 1980

[54] WRAPPING MACHINES

[75] Inventor: Reginald F. Johnson, Lea, near Gainsborough, England

[73] Assignee: Baker Perkins Holding Limited, Peterborough, England

[21] Appl. No.: 909,467

[22] Filed: May 25, 1978

[51] Int. Cl.[2] ..... B65B 11/38

[52] U.S. Cl. ..... 53/537; 53/231; 53/234

[58] Field of Search ..... 53/230, 231, 232, 233, 53/234, 537; 198/425, 627, 726

[56] References Cited

U.S. PATENT DOCUMENTS

| | | | |
|---|---|---|---|
| 2,373,655 | 4/1945 | Bronander | 53/234 |
| 2,639,070 | 5/1953 | Olson | 198/425 X |
| 3,055,490 | 9/1962 | Anderson | 53/234 X |
| 3,465,489 | 9/1969 | Monaghan | 53/230 X |

*Primary Examiner*—John Sipos

*Attorney, Agent, or Firm*—Watson, Cole, Grindle & Watson

[57] ABSTRACT

A wrapping machine comprising an intermittently rotating wrapping wheel having individual pockets for receiving in succession an article to be wrapped and a wrapper, the wrapping wheel being operative during its rotation to fold the wrappers partially around the articles and to bring the pockets, each containing a partially wrapped article, in succession to a transfer station, and a continuously moving conveyor carrying a series of pushers, said pushers being arranged to move through the pockets of the wrapping wheel in succession as they reach and while they are stationary at the transfer station, to withdraw the partially wrapped articles from the pockets and traverse them in succession through a final wrapping station at which the wrap is completed.

6 Claims, 7 Drawing Figures

WRAPPING MACHINES

Figure 1:
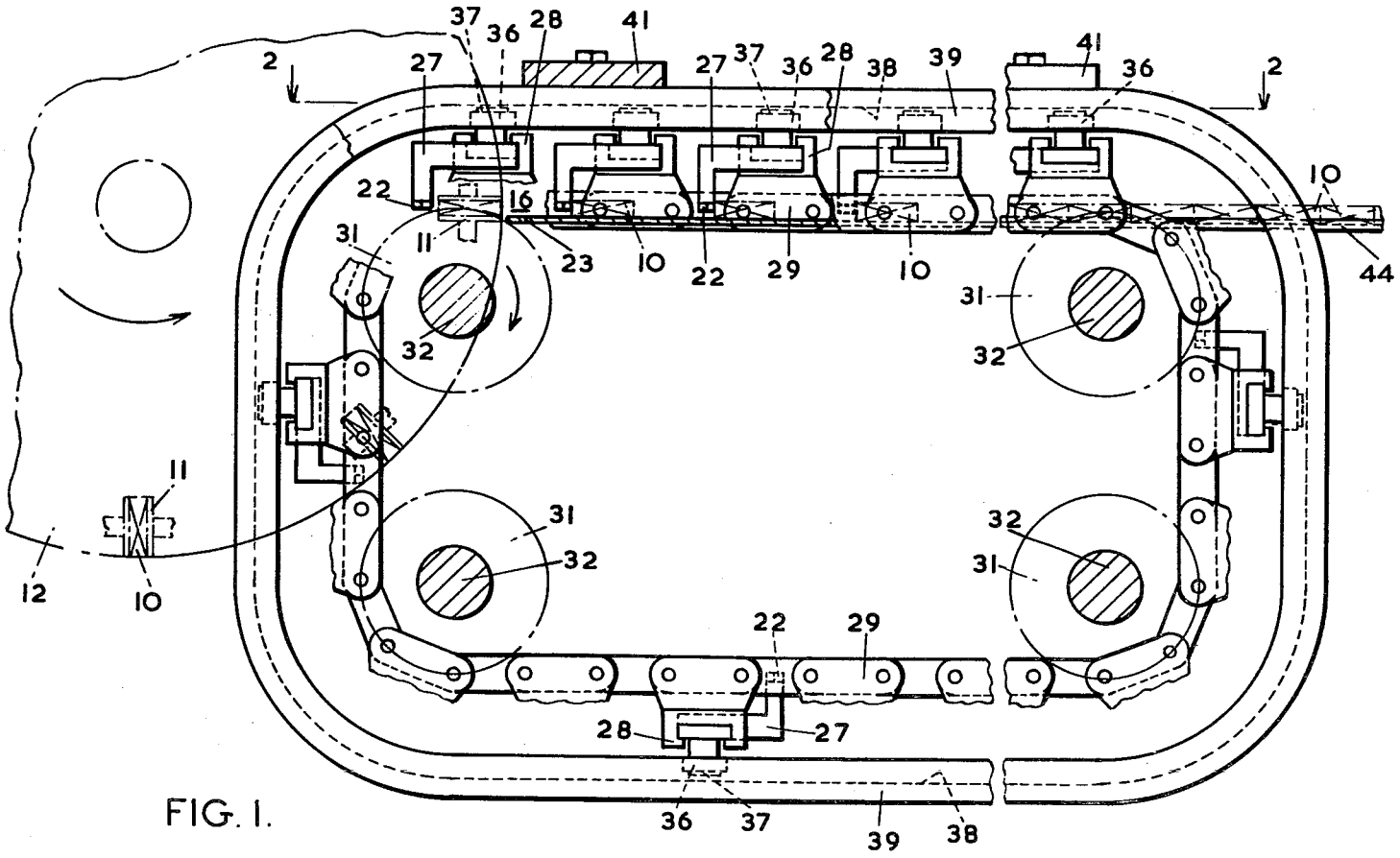

It is well known to provide for use in the wrapping of sweets an intermittently rotating wrapping wheel to which the sweets to be wrapped are fed in succession and from which partially wrapped sweets are delivered during appropriate pauses in the rotational movement of the wrapping wheel.

While the intermittently operating wrapping wheel serves well for carrying out the complex operations of bringing the wrapping material into contact with the sweets and partially wrapping it around the sweets, such intermittent operation has been found to be undesirable in further operations to be carried out on the partially wrapped sweets, especially where very high outputs of wrapped sweets are required.

The present invention accordingly provides a wrapping machine comprising an intermittently rotating wrapping wheel having individual pockets for receiving in succession an article to be wrapped and a wrapper, the wrapping wheel being operative during its rotation to fold the wrappers partially around the articles and to bring the pockets, each containing a partially wrapped article, in succession to a transfer station, and a continuously moving conveyor carrying a series of pushers, said pushers being arranged to move through the pockets of the wrapping wheel in succession as they reach and while they are stationary at the transfer station, to withdraw the partially wrapped articles from the pockets and traverse them in succession through a final wrapping station at which the wrap is completed.

Preferably, the final wrapping of the articles is carried out by continuous advance of the articles past stationary folder blades which engage portions of the wrapper projecting from the ends of each article.

The machine may also include a batch forming station where the wrapped articles are arranged in batches, each consisting of a predetermined number n of articles, for delivery to a packing station where they are packed in batches in a tray or carton or to a further wrapping machine where each batch is enveloped in an outer wrapper of paper, film or foil to provide a wrapped batch of individually wrapped articles.

The articles may conveniently be advanced on a stationary support means by pairs of article advancing fingers, which may be arranged to move out of engagement with the articles by transverse withdrawal therefrom under the action of a common cam control means. For the formation of successive batches of articles it can furthermore be arranged that pairs of fingers engaging the last article in each batch to be formed are controlled by separate cam control means, whereby the pairs of fingers advancing all the articles of each batch except the last article are withdrawn transversely from engagement with the associated article under said common cam control means, while the pair of fingers engaging the last article of the batch remains in engagement with that article and becomes effective to advance the batch as a whole along a delivery channel until they have been transversely withdrawn under the control of the separate cam control means.

Figure 4:
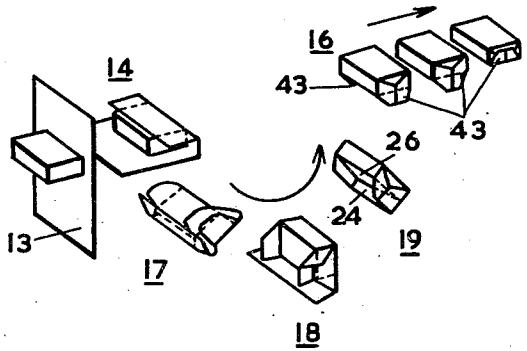
Figure 2:
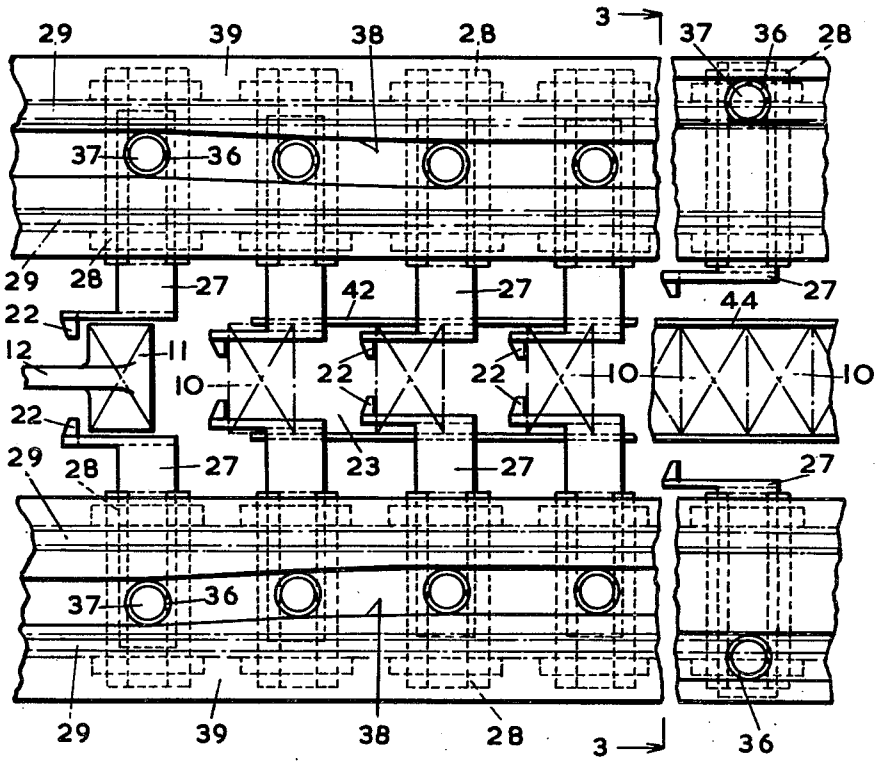
Figure 3:
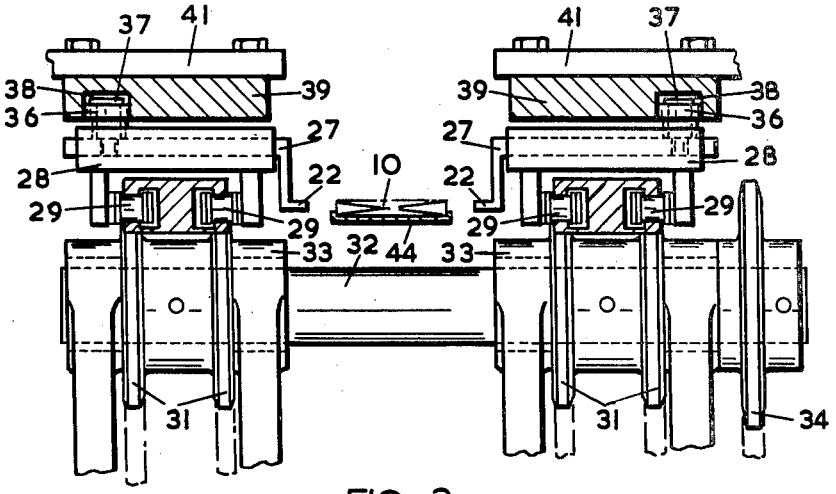
Figure 6:
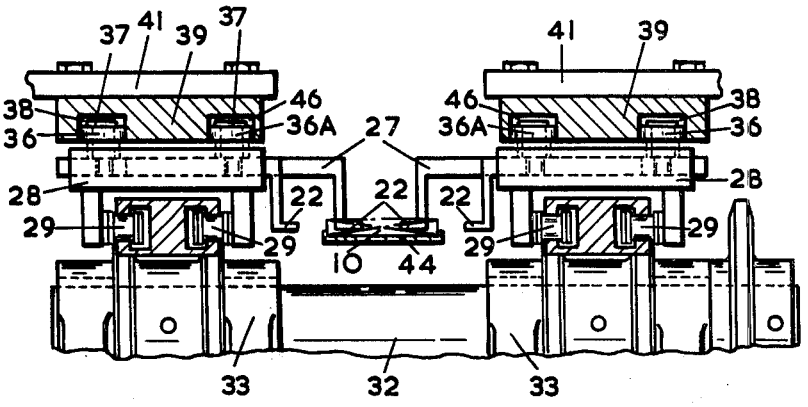
Figure 5:
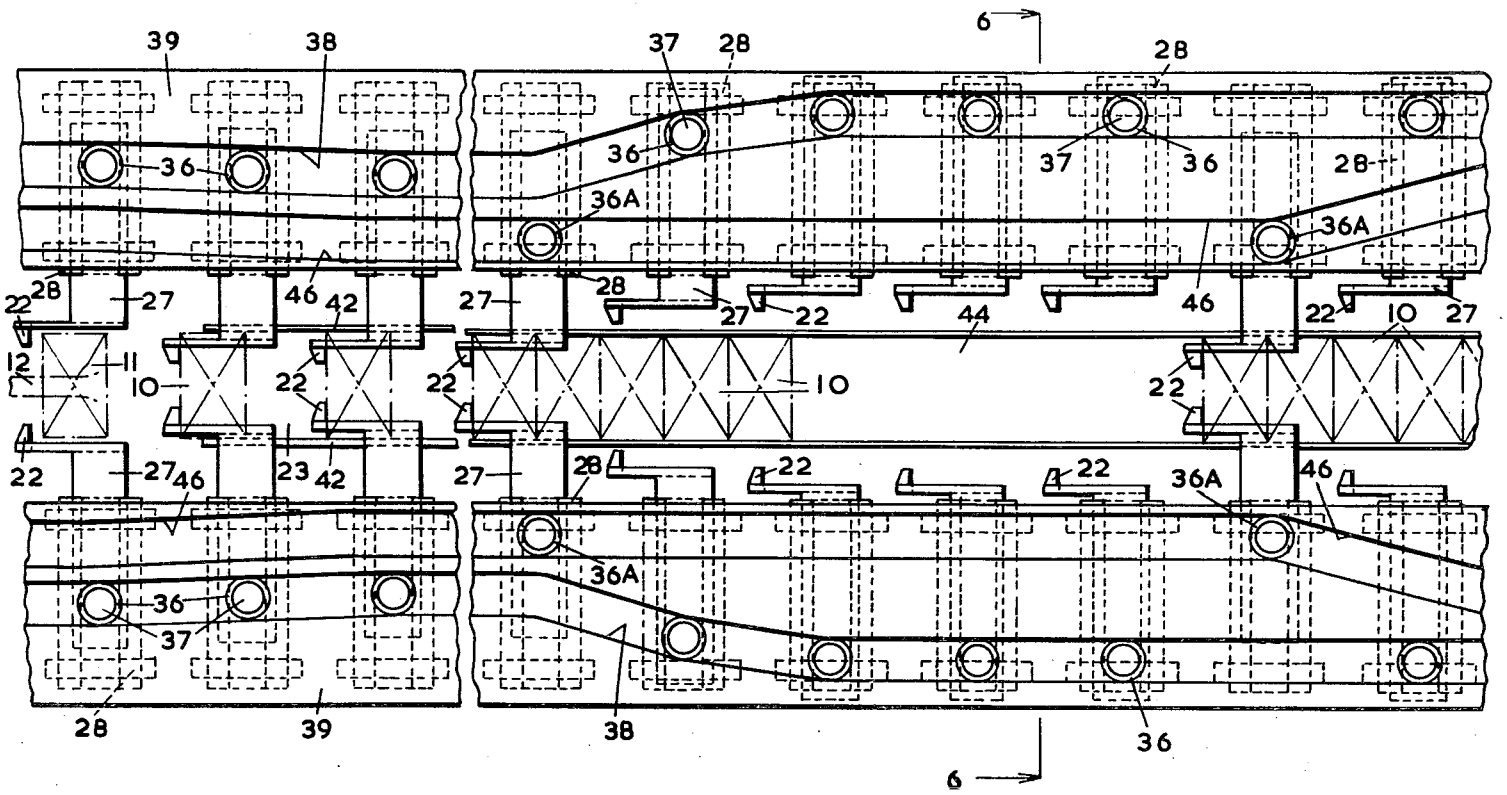
Figure 7:
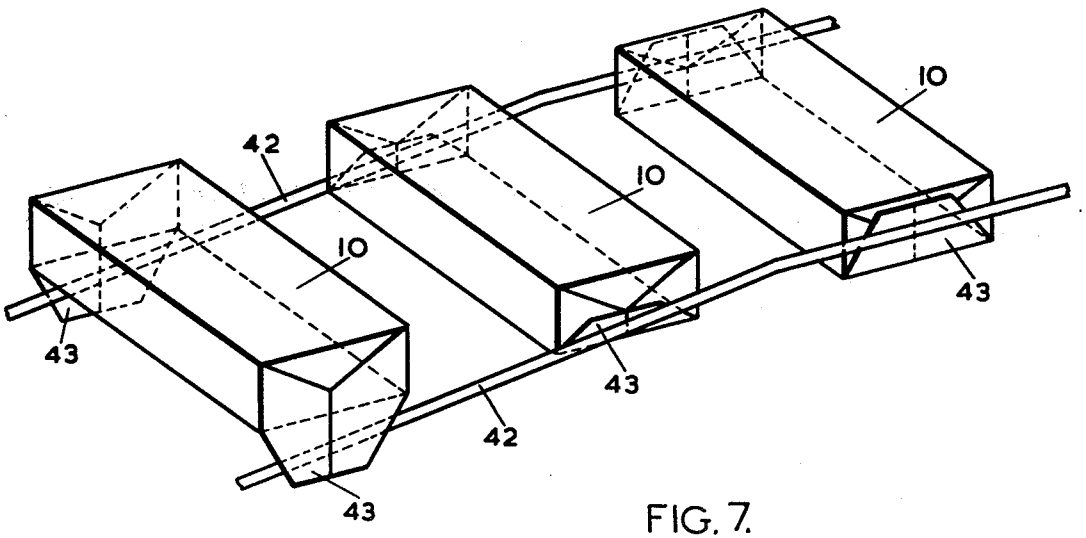

Embodiments of the invention will now be described by way of example with reference to the accompanying drawings in which:

FIG. 1 is an elevation, drawn partly in section, illustrating one embodiment of the invention, as applied to a sweet wrapping machine, FIG. 2 is a plan of the apparatus taken on the line 2—2 in FIG. 1, FIG. 3 is a section taken on the line 3—3 in FIG. 2, FIG. 4 is a diagram illustrating the style of wrap produced on the apparatus, FIG. 5 is a plan similar to FIG. 2, illustrating another embodiment of the invention, FIG. 6 is a section taken on the line 6—6 in FIG. 5, and FIG. 7 is a sketch illustrating the formation of the end folds of the wrappers.

As shown in FIGS. 1 and 4, sweets 10 are fed in succession, by conventional means (not shown), into successive pockets 11 in a wrapping wheel 12 which rotates intermittently about a horizontal axis, being driven in the conventional manner by a Geneva mechanism from a continuously rotating drive shaft also not shown, a wrapper 13 of heat-sealable wrapping material being fed across the path of each sweet 10 prior to its transfer into a pocket 11. As each sweet 10, together with its wrapper 13, is fed into the pocket 11 the wrapper 13 is folded around the forward face and the upper and lower surfaces of the sweet 10 as shown at 14 in FIG. 4. Rotation of the wrapping wheel 12 carries each sweet 10 in turn towards a transfer station 16 and, during such movement, the wrapper 13 is folded in well known manner around the sweet in successive stages, as shown at 17, 18 and 19 in FIG. 4, by stationary folders (not shown) arranged on either side of the wrapping wheel 12. Upon arrival of each partially wrapped sweet at the transfer station 16, and during a period of dwell of the wrapping wheel, one of a series of pairs of co-operating fingers 22 engages the rear face of the sweet to withdraw it from the pocket 11 at the transfer station on to a support 23, such movement causing a portion 24 of the wrapper 13 depending from the leading face of the sweet 11 to be folded on to the portion 26 of the wrapper 13 which has already been folded against the base of the sweet, leaving end portions 43 of the wrapper projecting downwardly at each end of the sweet.

As shown most clearly in FIGS. 2 and 3, the fingers 22 which withdraw the sweet from the pocket 11 extend inwardly from respective bars 27, which are mounted in respective slideways 28 carried by pairs of continuously moving endless conveyor chains 29 mounted on opposite sides of the support 23 on pairs of sprockets 31 secured to shafts 32 rotatably mounted in a framework 33, one of the shafts 32 being driven by chain and sprocket gearing 34 from a motor (not shown). Each bar 27 carries a roller 36 (FIG. 3), which is freely mounted on a stud 37 secured to the bar 27, the rollers 36 running in respective cam tracks 38 formed in plates 39 secured by brackets 41 to the framework of the machine.

The cam tracks 38 are so shaped as to cause successive co-operating pairs of fingers 22 firstly to withdraw sweets 10 from successive pockets 11 of the wrapping wheel 12 on to the support 23 as mentioned above, and then move the sweets 10 along the support 23 towards folder blades, not shown in FIGS. 1–4 but illustrated in FIG. 7, which are disposed on opposite sides of the support 23, and fold the downwardly extending portions 43 (FIG. 4) of the wrapper 13 at the ends of each sweet 10 through 180° on to the end faces of the sweet 10 to complete the wrapping operation as shown at the extreme right hand side of FIG. 4. To enable this final folding operation to take place the fingers 22 are moved inwardly towards each other by the tracks 38, so that they are moved clear of the folder blades 42. Upon completion of the final folding operation the fingers 22 move the wrapped sweets 10 further along the support 23 between end sealing elements (not shown) which seal the final end folds.

FIG. 7 illustrates the operation of the folder blade 42 at one end of the sweets and it will be understood that the operation of the other folder blade is precisely similar. The portions 43 of the wrapper of each sweet, as the sweets move from left to right as seen in FIG. 7, first encounter the outer sides of ascending portions of the blades 42. After they have been partially folded in an upward direction, the portions 43 are engaged by the inner sides of the blades, as shown at the centre of FIG. 7, and the blades finally cause the portions 43 to engage the ends of the sweet.

The fingers 22 then move the sweets 10 along a delivery channel 44 towards a delivery station at which the tracks 38 cause the fingers 22 to move outwardly to withdraw clear of the sweets, which are transferred from the delivery station into a tray or carton either manually or by mechanical means (not shown). As will be noted, FIG. 1 is broken away and shows only five pairs of fingers 22 in each horizontal section of the conveyor chains 29 between the end sprockets 31. In fact there are sixteen pairs of fingers 22 in each such horizontal section and these move out of engagement with the sweets before they reach the right hand sprockets 31.

In the further embodiment of the invention illustrated in FIGS. 5 and 6, the machine is similar in all respects to that described in connection with the embodiment illustrated in FIGS. 1 to 4 with the exception that the rollers controlling every fifth pair of co-operating fingers 22, which are numbered 36A in these Figures, are arranged to run in separate cam tracks 46 formed in the plates 39. As the fingers 22 move the sweets 10 into the delivery channel 44 the tracks 38 controlling the movement of the first four pairs in each series of five fingers 22 cause those fingers 22 to withdraw clear of the sweets as described above whilst the tracks 46 controlling the fifth pair of fingers 22 continue to maintain the latter in contact with the rear face of the fifth sweet in the series. Thus, successive batches of five wrapped sweets are collated in the channel 44 and moved to the delivery station by the fingers 22.

As each collated batch of sweets 10 arrives at the delivery station the tracks 46 coact with the rollers 36A to cause the remaining pair of fingers 22 to withdraw clear of the batch as shown at the right hand side of FIG. 5. As in the first described embodiment, the batches may be transferred from the delivery station into a tray or carton either manually or by mechanical means (not shown).

Alternatively, the collated batches of sweets may be transferred in succession from the delivery station into a further wrapping machine where they are enveloped in wrappers of paper, film or foil to provide wrapped batches of individually wrapped sweets.

Although in the embodiment of the invention hereinbefore described, the machine is designed to collate batches of five wrapped sweets 10, it will be appreciated that the apparatus may be so constructed as to provide wrapped sweets 10 in batches of any other number of sweets. Furthermore, it is a simple operation to rearrange the pairs of fingers 22 for advancing the last sweet 10 in each batch so as to increase or decrease the number of sweets in a batch or to replace them by fingers controlled only by the tracks 38 where the operation of forming batches is not required.

What I claim as my invention and desire to secure by Letters Patent is:

1. A wrapping machine comprising an intermittently rotating wrapping wheel having individual pockets for receiving in succession an article to be wrapped and a wrapper, the wrapping wheel being operative during its rotation to fold the wrappers partially around the articles and to bring the pockets, each containing a partially wrapped article, in succession to a transfer station, a continuously moving chain conveyor carrying a series of pushers, said pushers being arranged to move through the pockets of the wrapping wheel in succession as the pockets reach and while the pockets are stationary at the transfer station, to withdraw the partially wrapped articles from the pockets and traverse them in succession through a final wrapping station, stationary folder blades at said final wrapping station which extend generally parallel to said chain conveyor adjacent the two ends of the articles and which engage portions of the wrapper projecting from the ends of each article to complete the wrap of said articles, said pushers being constituted by pairs of fingers mounted on said chain conveyor adjacent opposite ends of the articles, said fingers engaging the partially wrapped articles to feed them in succession along a stationary support, and a control mechanism operative to move the fingers of each pair inwardly towards one another to positions clear of said stationary folder blades during passage of the articles past the folder blades.

2. A wrapping machine according to claim 1, which includes end sealing elements, situated beyond the folder blades, which seal the folds at the ends of the articles.

3. A wrapping machine according to claim 1, which includes a delivery channel situated beyond the folder blades and into which the wrapped articles are fed in succession by the fingers and in which the cam control is effective to move the fingers outwardly to positions clear of the articles after the articles have been fed into the delivery channel.

4. A wrapping machine according to claim 1, which is effective to collate the wrapped articles into batches each consisting of n articles and which includes a delivery channel situated beyond the folder blades and into which the wrapped articles are fed in succession by the fingers, each $n^{th}$ pair of fingers being controlled by a second cam control mechanism separate from that controlling the other pairs of fingers, the cam control mechanism associated with said other pairs of fingers being effective to move these fingers outwardly to positions clear of the articles after the articles have been fed into the delivery channel and the second cam control mechanism maintaining the associated pairs of fingers in contact with their respective articles for a time sufficient to collate the articles into batches in the discharge channel and only thereafter causing outward movement of said fingers to clear the articles.

5. A wrapping machine according to claim 3, wherein the cam control mechanism comprises a pair of cam tracks engaging rollers attached to the fingers of each pair.

6. A wrapping machine according to claim 4, wherein the cam control mechanisms comprise separate pairs of cam tracks, each of which engages rollers attached to the associated pairs of fingers.

* * * * *